US009229359B2

(12) United States Patent
Fogh-Hansen

(10) Patent No.: US 9,229,359 B2
(45) Date of Patent: Jan. 5, 2016

(54) DOCTOR BLADE CHAMBER SEAL

(71) Applicant: Tresu A/S, Bjert (DK)

(72) Inventor: Christian Fogh-Hansen, Bjert (DK)

(73) Assignee: Tresu A/S, Bjert (DK)

( * ) Notice: Subject to any disclaimer, the term of this patent is extended or adjusted under 35 U.S.C. 154(b) by 0 days.

(21) Appl. No.: 14/371,539

(22) PCT Filed: Jan. 10, 2013

(86) PCT No.: PCT/DK2013/050007

§ 371 (c)(1),
(2) Date: Jul. 10, 2014

(87) PCT Pub. No.: WO2013/104366

PCT Pub. Date: Jul. 18, 2013

(65) Prior Publication Data

US 2014/0373740 A1 Dec. 25, 2014

(30) Foreign Application Priority Data

Jan. 10, 2012 (DK) ..... 2012 70014

(51) Int. Cl.
*B41F 31/02* (2006.01)
*G03G 15/08* (2006.01)

(52) U.S. Cl.
CPC ..... *G03G 15/0817* (2013.01); *B41F 31/027* (2013.01); *G03G 15/0808* (2013.01)

(58) Field of Classification Search
CPC ..... B41F 9/1063; B41F 9/065; B41F 9/068; B41F 31/027; B41F 31/02; F16J 15/3232; F16J 15/3204; F16J 15/32
See application file for complete search history.

(56) References Cited

U.S. PATENT DOCUMENTS

| | | | | |
|---|---|---|---|---|
| 5,125,341 | A | 6/1992 | Yaeso | |
| D488,503 | S | 4/2004 | Iversen | |
| 6,739,248 | B2 * | 5/2004 | Kolbe et al. | 101/169 |
| 7,597,761 | B2 * | 10/2009 | Van Denend | 118/410 |
| 2008/0034997 | A1 | 2/2008 | Van Denend | |
| 2011/0056395 | A1 * | 3/2011 | Gydesen et al. | 101/208 |

FOREIGN PATENT DOCUMENTS

| | | | |
|---|---|---|---|
| CN | 2616375 | Y | 5/2004 |
| CN | 201544528 | U | 8/2010 |
| CN | 201587172 | U | 9/2010 |
| EP | 0 401 250 | B1 | 4/1995 |

(Continued)

*Primary Examiner* — Daniel J Colilla
*Assistant Examiner* — Leo T Hinze
(74) *Attorney, Agent, or Firm* — Roberts Mlotkowski Safran & Cole, PC; David S. Safran

(57) ABSTRACT

A printing unit has a doctor blade chamber, a rotatable roller, and a gasket for sealing between the doctor blade chamber and the roller. One end of the gasket has at least one sealing surface directed towards the doctor blade chamber, the gasket having a thickness which is delimited by a first edge and a second edge at the sealing surface. The other end of the gasket has an elastomeric edge for sealing abutment against the roller, the elastomeric edge being offset in a longitudinal direction of the roller relative to at least one of the first and second edges and delimits the thickness of the sealing surface. The a surface of the gasket extending between the doctor blade chamber and the roller is inclined at an angled of less than 90° relative to longitudinal axis of the roller and/or the sealing surface, and is concave and/or convex.

17 Claims, 8 Drawing Sheets

(56) References Cited

FOREIGN PATENT DOCUMENTS

| | | | |
|---|---|---|---|
| EP | 2 425 972 | A2 | 3/2012 |
| JP | 10-137648 | A | 5/1998 |
| WO | 89/07047 | A1 | 8/1989 |
| WO | 2009/024151 | A1 | 2/2009 |
| WO | 2009/053504 | A1 | 4/2009 |
| WO | 2009/099564 | A1 | 8/2009 |
| WO | 2010/060433 | A1 | 6/2010 |

* cited by examiner

DOCTOR BLADE CHAMBER SEAL

BACKGROUND OF THE INVENTION

1. Field of the Invention

The present invention concerns a printing unit with a doctor blade chamber and a rotatable roller where the roller extends partially into the doctor blade chamber for receiving ink from the doctor blade chamber during operation, wherein a gasket is provided for sealing between the doctor blade chamber and the roller, where the gasket at one side includes at least one sealing surface, the sealing surface having a width substantially corresponding to the width of the doctor blade chamber and a thickness in longitudinal direction of the roller, the thickness delimited by a first edge and a second edge at the sealing surface, wherein the gasket at its opposing side includes an elastomeric edge for sealing abutment against the roller, wherein the elastomeric edge is offset in longitudinal direction of the roller/doctor blade chamber relative to at least one of the edges that delimit the thickness on the sealing surface, where a surface extending from at least one of the edges and to an area at the elastomeric edge/roller delimit the thickness of the sealing surface, wherein the surface is inclining corresponding to it being angled less than 90° in relation to the sealing surface or the longitudinal direction of the roller/doctor blade chamber, is concave and/or is convex. The invention further concerns a gasket for sealing between a doctor blade chamber and a rotatable roller in a printing unit.

2. Description of Related Art

A rotary printing unit for colour printing or for application of lacquer on printed matter typically comprises a semi-open doctor blade chamber with ink which is transferred to a screen roller in that the screen roller while rotating runs with part of its surface submerged in the ink bath in the doctor blade chamber. In order to seal the semi-open chamber towards the ink roller, the doctor blade chamber is connected with a doctor blade bearing against the roller. The ends of the doctor blade chamber are sealed with rubber gaskets which are embedded in the doctor blade chamber with their bottoms and which have a curving top side in contact with the roller. Such rubber gaskets can also be used for dividing the doctor blade chamber into several sections with ink baths.

In EP 401 250 is disclosed a doctor blade device which is represented in FIG. 1. The device includes a chamber bar with a U-shaped doctor blade chamber 3 with bottom 3A and sides 3B and 3C which during operation contain ink for a printing unit with a screen roller (not shown) which is in contact with the ink in the chamber 3. Two doctor blades 1, 2 are clamped to the chamber 3 by rails 5, 6, having the function of sealing against the screen roller, its surface being in contact with the ink in the chamber 3. Ink can be conducted into the chamber 3 via channels 8. Two channels 8 are shown, one for each part chamber in the chamber 3, wherein the part chambers are provided by delimitation by means of a packing 4 inside the chamber and a packing 4 at the end of the chamber. The packing 4 has a concave shape 4A for bearing against the screen roller.

A packing of this type is reproduced in FIG. 2 which is a copy of the U.S. design Pat. No. D 488,503. This packing has a central section with a sharp rail 7 of a hard material for bearing against the screen roller for enhanced sealing. Packings or gaskets with rails for bearing against the screen roller are also described in WO 2009/024151.

In general, long life of the sealing and the tightness between the doctor blade chamber and the roller are important aspects and subject to continuous improvement. For example, it is desirable with improved durability of the packings or gaskets, and at the same time it is desired that the gaskets are more tight in general, even in case of incipient wear. Even though the above described hard rails in the gaskets are an improvement compared with the prior art, these gaskets have the drawback that the colour pigments are wearing considerably on the hard rails. Making these rails even harder may reduce wear but implies a risk of more rapid wear on the screen roller at the line of contact with the rail. It is thus desirable to use a type of gaskets where the service life is high and wherein tightness is improved during normal operation and up to the point where the gasket/packing is worn out.

SUMMARY OF THE INVENTION

Therefore, it is the object of the invention to provide an improvement on this technical area. In particular, it is the object to provide an improved gasket for sealing between the doctor blade chamber and the screen roller wherein durability as well as sealing ability are improved. It is furthermore an object to indicate a gasket which is suited for use in connection with screen rollers with varying diameters wherein a certain type of gasket thus can be used for rollers with several different diameters. At the same time it is, as mentioned, an object to indicate a gasket and a printing unit with such gaskets wherein there is achieved improved sealing but also prolonged service life and thereby less wear on gasket as well as on screen roller.

This object is achieved by a printing unit and by a gasket as described below. The printing unit according to the invention is provided with a doctor blade chamber and a rotatable roller as mentioned in the introduction, wherein a gasket provides sealing between the doctor blade chamber and the roller, where the gasket has an elastomeric edge which is offset in longitudinal direction of the roller/doctor blade chamber relative to at least one of the edges delimiting the thickness of the sealing surface, wherein a surface extending from at least one of the edges and to an area at the elastomeric edge/roller delimit the thickness of the sealing surface, wherein the surface is inclining corresponding to it being angled less than 90° in relation to the sealing surface or the longitudinal direction of the roller/doctor blade chamber, is concave and/or is convex.

The novel details about such a printing unit and such a gasket is that the gasket has a non-symmetric cross sectional shape, where the surface extending from at least one of the mentioned edges and to an area at the elastomeric edge/roller, constitutes a first leg comprising a backside, where said backside is supported by a second leg. By having said surface angled and supported as mentioned, a gasket suited for use in connection with screen rollers with varying diameters is obtained, where a certain type of gasket thus can be used for rollers with several different diameters.

An additional advantage of the gasket having an inclining surface is that a gasket with given dimensions, as already mentioned, can be used for rollers with varying diameters. This is possible as the elastomeric edge in most cases by far can be urged to fit tightly against the surface of the roller without any further problems. This is particularly due to the fact that the edge is inclining and therefor does not bear on the roller at right angles. As the surface is inclining, it can more easily be pressed/deformed and thereby adapted to the different diameters of the rollers. By the prior art solutions where the gaskets have a rigid rail arranged at right angles to the roller, this flexibility cannot be achieved. But irrespectively whether the gasket has a uniform material structure or whether reinforcing or supporting elements are arranged in the gasket, the inclining surface extending from the edge of the gasket in the doctor blade chamber and to the elastomeric edge at the roller can be adapted as described here.

In principle, this surface is the face constituting one side of a gasket. The surface connecting an edge with the elastomeric edge can be an angled plane surface but it may, as mentioned, also be curved with either a concave or a convex shape. It is even possible that the surface can contain plane, convex, and/or concave subsurfaces at one and the same time, where between such possible subsurfaces there is provided a smooth and uniform transition. Generally speaking, the elastomeric edge is withdrawn relative to edge of the sealing surface, i.e. an offset is provided between elastomeric edge and the edge of the sealing surface in longitudinal direction of the roller/doctor blade chamber. If the surface between edge and elastomeric edge is not plane but has a different shape, the direction on the surface can be described by a tangent to the geometry of the surface where the tangent is angled relative to vertical, construed as the tangent being inclined. Irrespective whether the surface has one or the other geometric shape, in the following it will only be referred to by the term 'inclining' which is thus to be understood as inclining as well as concave and/or convex.

In that the gasket has the elastomeric edge offset in the longitudinal direction relative to the edge of the sealing surface, wherein the surface between the two said edges are arranged inclining, so to say, there is achieved the surprising advantage that the gasket remains tight for a longer time. By examining more closely, it has been ascertained that this fact is due to the way in which the ink in the doctor blade chamber is moving when the roller rotates. The ink in the doctor blade chamber is to be understood in a wide sense in this regard as it may be actual ink, but may also be lacquer applied on all or parts of a print item by the printing unit.

The ink which has a certain viscosity is deposited on the roller when the latter is rotated. The roller, also called a screen roller or anilox roller, is equipped with numerous small indentations in which the ink is received. A doctor blade scrapes off excessive ink and the ink in the indentations can be transferred to the actual print items. When the roller is rotated, the ink on the roller is urged in direction away from the roller. The ink will, so to say, be urged to be flung off the roller if the peripheral speed of the roller and the adherence of the ink to the roller are not matched. Moreover, there is friction between ink and roller why the ink in the doctor blade chamber is brought to rotate when the unit is in use. Ideally it can be said that the ink will rotate in the doctor blade chamber about an imaginary axis which is parallel with the roller, and that the ink rotates in opposite direction as the roller. When a gasket is provided in the doctor blade chamber where an inclining surface is disposed on the gasket, it occurs that the ink on the roller at the contact of the inclining surface against the roller will be flung against the inclining surface and along the latter against the bottom of the doctor blade chamber. Hereby, a flow will be induced along the inclining surface and away from the roller.

Actually it appears that a flow eddy arises in the ink in the area along the inclining surface on the gasket where the ink due to this flow so to say is forced away from the area between the roller and the elastomeric edge on the gasket. Thus a kind of negative pressure is produced in the sealing area which certainly is an advantage as the load on the gasket thus becomes appreciably less than by the prior art types of gaskets. The effect is thus that the ink, due to the inclining surface, is brought into a flow that reduces the pressure on the gasket, and thereby the desired benefits of an improved gasket—a better sealing—are achieved, and simultaneously is achieved increased durability of the gasket as it not so heavily loaded by ink pigments or other particles in the ink wearing on the gasket and also on the screen roller.

In a preferred embodiment of a printing unit and a gasket according to the invention, the gasket includes a rigid/hard and supporting rail. In some embodiments, this rigid and supporting rail bears against the roller together with the elastomeric edge under operational conditions of the printing unit. Alternatively, under operational conditions the rail is spaced apart from the roller, and only the elastomeric edge is bearing against the roller. This means that the elastomeric edge is supported by the rail, either right up to the roller or supported until a short distance from the roller, for example a spacing between 0 and 7 mm, but preferably with a spacing between 0 and 3 mm between the roller and the rail.

Surprisingly, it has appeared that such a gasket compared with a gasket according to prior art, e.g. as described in WO 2009/024151, has about twice as long service life.

In comparison it can be mentioned that gaskets of mutually similar types have a service life of two hours by a gasket with rubber edge against the roller where the rubber edge was not supported by a rigid rail;

a service life of 16 hours by a gasket with a sharp edge as disclosed in WO 2009/024151; and a service life of 35 hours by a gasket with a rail-supported rubber edge according to the invention.

Also, it has appeared that a gasket with the rail-supported elastomeric edge is particularly useful by printing units with high rotational speeds of the roller, e.g. by a tangential speed of 500 to 800 m/min, favourising this type of gasket particularly by high-speed production. Due to the longer service life and the consequent fewer interruptions at which gaskets are to be replaced, the gasket according to the invention is a substantial improvement with regard to production efficiency.

The term "rigid rail" means that the rail, as compared with the elastomer of which the gasket itself is made, is made of a stiffer/harder material which thus can exert a supporting action on the softer and less rigid elastomeric edge/rubber edge.

For the sake of good order it is to be mentioned that the rigid/supporting rail does not necessarily need to extend along the entire length of the gasket but may only extend along a part or some parts thereof. For example, the rigid/supporting rail can be with a varied cross-section at least in the width direction of the gasket whereby the rigidity in the rail can be varied across the width of the gasket and thus be adapted to specific needs.

Such a rigid/supporting rail can furthermore be provided as a flat profile which is substantially perpendicular to the sealing surface and the bottom of the doctor blade chamber. The rigidity of such rigid/supporting rail may advantageously be adapted such that the inclining surface on the gasket can be adapted to different roller diameters. However, it is also possible to design a gasket with a rigid/supporting rail which is angled in relation to the sealing surface and the bottom of the doctor blade chamber. As mentioned, the rail can be a flat profile but can also be made with V-shape or T-shape which is illustrated in the Figures below.

In a preferred variant of a printing unit with a doctor blade chamber and a rotatable roller according to the invention, the doctor blade chamber can include two gaskets, where each of the two gaskets includes an oblique, a concave, and/or a convex surface, where the surfaces face each other such that the distance between the two elastomeric edges is greater than the distance between the mutually facing edges at the sealing surface of the gasket. This way of disposing the gaskets in the doctor blade chamber provide the above mentioned advantages as the ink will be urged to rotation in the gasket area by the friction force between the roller and the ink. This way of disposing the gaskets is particularly suited for so-called pressure-less systems where the same pressure prevails inside the doctor blade chamber as outside the doctor blade chamber.

In another variant of a printing unit with a doctor blade chamber and a rotatable roller according to the invention, the doctor blade chamber can include two gaskets, where each of the two gaskets includes an oblique, a concave, and/or a convex surface, where the surfaces face away from each other such that the distance between the two elastomeric edges is less than the distance between the mutually facing edges at the sealing surface of the gasket. It is the same type of gasket as mentioned above, but by reversing the gaskets it has appeared that very good results are obtained when used in doctor blade chambers in which an overpressure is applied. This advantageous application is due to the fact that the pressure in the ink acts on the back side of the inclining surface which then is pressed against the surface of the roller and seals even better, though of course with increased friction between gasket and screen roller.

A gasket for sealing between a doctor blade chamber and a rotatable roller in a printing unit according to the invention can be with the body of the gasket made of rubber with a first rigidity/hardness, and where the rigid/supporting rail is made of a thermoplastic with a second rigidity/hardness, wherein the second rigidity/hardness is greater than the first rigidity/hardness.

Both the body and the rail may, however, be made of other materials, where the body is made from e.g. EPDM rubber and usable materials for the rail include among others metal, e.g. copper, and hard polymers, e.g. polyurethane, polyethylene, polypropylene, polyoxymethylene (POM) or combinations thereof. Such polymers may furthermore be reinforced by e.g. glass fibres or carbon fibres.

A gasket for sealing between a doctor blade chamber and a rotatable roller in a printing unit according to the invention can be made such that the rigid/supporting rail includes or is constituted by a thread, where the thread is arranged in the body of the gasket in a direction that substantially coincides with the width direction of the gasket. Such a thread can be of a suitable material, with a suitable rigidity and may thus support the elastomeric edge when the latter bears on the roller.

Such a thread can include projecting anchor parts, e.g. threads extending in one or more direction relative to the longitudinal direction of the thread and which ensures a more stable position of the thread in the gasket body itself.

In principle, the rigid rail can be made of the same material as the elastomeric edge itself, however with the difference that the hardness/rigidity is different in the two parts. This may possibly be achieved by a suitable treatment of one of the two parts. Furthermore, the rigid rail can be adapted such that after a given operational time in contact with the roller it is worn to fit, so to say, thereby achieving a perfectly adapted shape in relation to the roller. In this way is achieved the most optimal fit between a gasket and the roller.

In a preferred variant of a gasket according to the invention, the gasket is made such that between the rigid and supporting rail and the softer elastomeric edge there is a stable joint; the rail and the elastomeric edge may e.g. be chemically connected or mutually attached in another secure and strong way.

The rail can be made by a first process, and by a second process be moulded into the elastomer constituting the body itself and possibly the greater part of the gasket, but a gasket for sealing between a doctor blade chamber and a rotatable roller in a printing unit according to the invention can include a body made of an elastomer with a first rigidity/hardness and a rigid/supporting rail made of an elastomer with a second rigidity/hardness, wherein the second rigidity/hardness is greater than the first rigidity/hardness, and wherein the gasket constitutes a unit produced by multi-component moulding in one single operation.

The term "elastomeric edge" implies that it is the edge of an elastomeric material which bears against the roller as a sealing means. This is in contrast to WO 2009/024151 where the sharp rigid rail bears against the roller and has the sealing function. Rubber or synthetic elastomeric materials can advantageously be used as elastomer.

The gasket itself has a body with a sealing surface for sealing abutment against a bottom in the doctor blade chamber, and at a side opposite the sealing surface the gasket includes an elastomeric edge for sealing abutment against the roller and may include a rigid rail for supporting the elastomeric edge. The rail can be embedded in the body and extend out from the body. It is possible with an elastomeric edge at one side of the rail only, and it is also possible with an elastomeric edge at both sides of the rail. If a single elastomeric edge is used for bearing on the roller it is advantageous if it is arranged at the side of the rail facing the ink bath of the doctor blade chamber.

In order to achieve the spacing between the rail and the roller, in some embodiments the gasket is provided with a rail having a distance from the elastomeric edge such that the elastomeric edge projects farther out from the body than the rail, e.g. a distance between 0 and 7 mm, but preferably a distance between 0 and 3 mm. Depending on many different conditions there may be reasons to have an elastomeric edge that is flush with the rigid edge, whereas other conditions can entail that a distance of up to 7 mm is more advantageous.

However, it is to be mentioned that a possible spacing between the elastomeric edge and the rail is reduced when the gasket is pressed against the roller and the elastomeric edge is deformed thereby. Depending on this pressure and the hardness and shape of the elastomeric edge, this spacing will be more or less reduced, e.g. so much that not only the elastomeric edge is bearing on the roller but the rail will come into contact as well.

Optionally, the gasket includes a first elastomeric lip extending up along one side of the rail and bearing against the roller during operation in order thereby to constitute the elastomeric edge. This means that the elastomeric lip projects farther out than the rail or is flush with the rail. If projecting farther out from the body than the rail, deformation of the lip when being pressed against the roller will either mean only so much deformation that a spacing between the rail and roller still remains, or so much more deformation that also the rail will come into contact with the roller. For example, the elastomeric lip projects farther out from the body than the rail at a distance between 0 mm and 7 mm, but preferably between 0 mm and 3 mm between the elastomeric edge and the rail.

Optionally, the gasket also includes a second elastomeric lip extending up along the opposite side of the rail. In further embodiments, the first elastomeric lip and a second elastomeric lip extend to various distances from the sealing surface at the bottom of the doctor blade chamber. The elastomeric lips may e.g. have so different dimensions so that only the first but not the second elastomeric lip bears against the roller during operation.

Since the elastomeric lips are supported by the rail they can be designed relatively thin which is an advantage at high speeds of the roller, as a thin elastomeric lip has less friction than a thick elastomeric lip. Advantageous thicknesses of such thin elastomeric lips are less than 2-3 mm, for example between 4 and 14 tenths of a millimeter.

Since the elastomeric edge is the element primarily having the sealing function irrespective of the presence of a rail or if the rail is bearing against the roller or not during operation, there is no need for the rail being sharp as described in WO 2009/024151. Therefore, in further embodiments the rail is blunt. In line with some of the embodiments in WO 2009/024151, the rail can be broken into sections in order to be bent resiliently under load by pressure action in spite of its orientation in parallel with pressing action.

In order to follow the curvature on the roller, the elastomeric edge, e.g. the elastomeric lip, has a concave course. Correspondingly, it is advantageous if the rail also has a concave course regardless of the fact that the rail is not necessarily in contact with the roller.

In practice the sealing is performed in the following way. A gasket is provided between a doctor blade chamber and a rotatable roller in a printing unit where the gasket at one side has a sealing surface for sealing abutment against a bottom in the doctor blade chamber and placed in the doctor blade chamber in an appropriate way as well. The gasket is additionally provided at one side opposite the sealing surface with an elastomeric edge for sealing abutment against the roller and possibly a rigid rail for supporting the elastomeric edge. The rail can be embedded in the body and extend out from the body. The rail has a distance from the elastomeric edge such that the elastomeric edge projects farther out from the body than the rail, e.g. a distance between 0 and 7 mm, but preferably a distance between 0 and 3 mm. The gasket is then brought in contact with the elastomeric edge, deforming the latter. The deformation can be so large that the rail also comes into contact with the rollers, but may alternatively be chosen such that the rail does not come into contact but has a small distance to the roller, e.g. between 0 and 7 mm, or maybe only between 0 and 3 mm, which has appeared to be optimal. The distance can also be greater, but in practice it has appeared that a relatively good and optimal support is achieved by distances up to 3 mm. If the gasket is provided with an elastomeric edge at one side of the rail only, the gasket is advantageously fitted with this elastomeric edge between the ink bath and the rail.

Practical experiments have shown that if the supporting rail and the elastomeric edge are at the same level, the best sealing and the longest service life for the gasket are achieved. Different types of ink, rollers, roller speeds, or other parameters may, however, have influence on these conditions. Thus there may be conditions that entail that it is more optimal with a slightly retracted supporting rail relative to the elastomeric edge.

By indications of distances/spacings as intervals between a first value and a second value, the end points of the intervals are included unless other is explicitly indicated. Reference numbers with reference to the drawings in the claims are not restrictive for the invention.

The invention is described in the following with reference to the drawing, wherein:

DETAILED DESCRIPTION OF THE INVENTION

In the explanation of the Figures, identical or corresponding elements will be provided with the same designations in different Figures. Therefore, no explanation of all details will be given in connection with each single Figure/embodiment.

Figure 1:
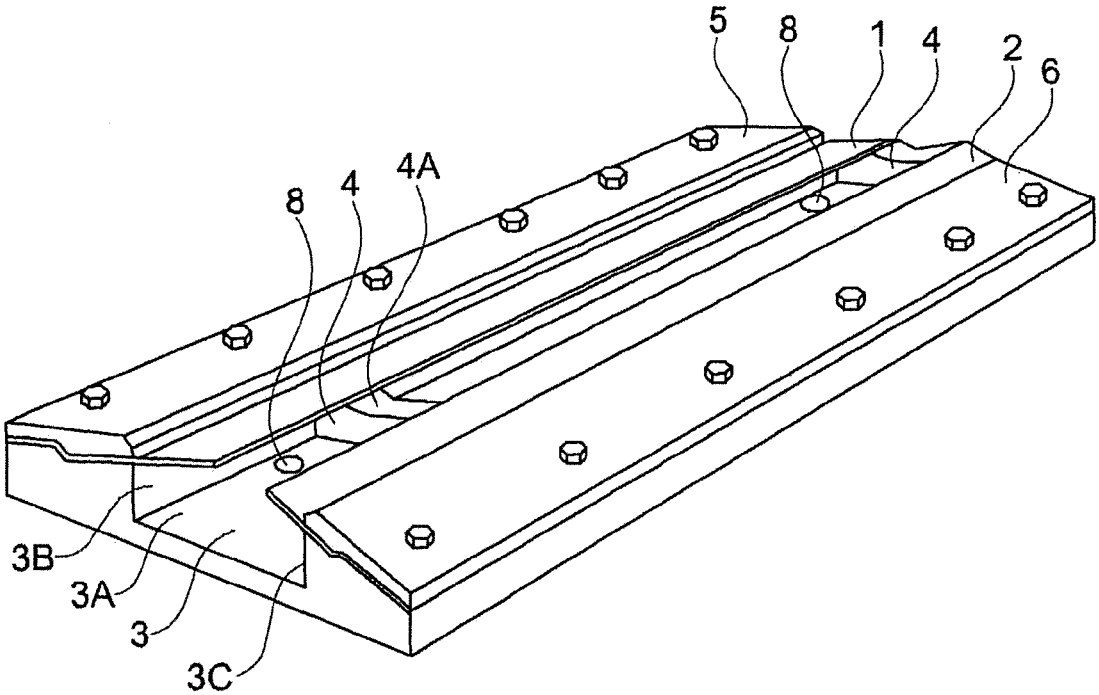
Fig. 1 (Prior Art)
FIG. 1 shows a doctor blade chamber according to prior art.
Figure 2:
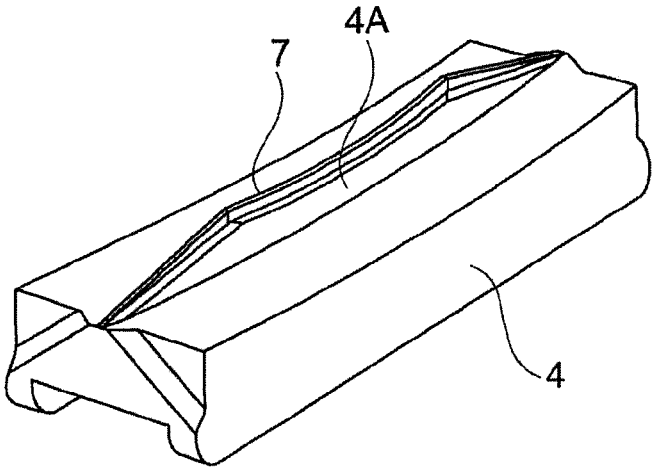
Fig. 2 (Prior Art)
FIG. 2 shows a gasket for a printing unit according to prior art.

FIGS. 1 and 2 are described as prior art in the introduction.

Figure 3:
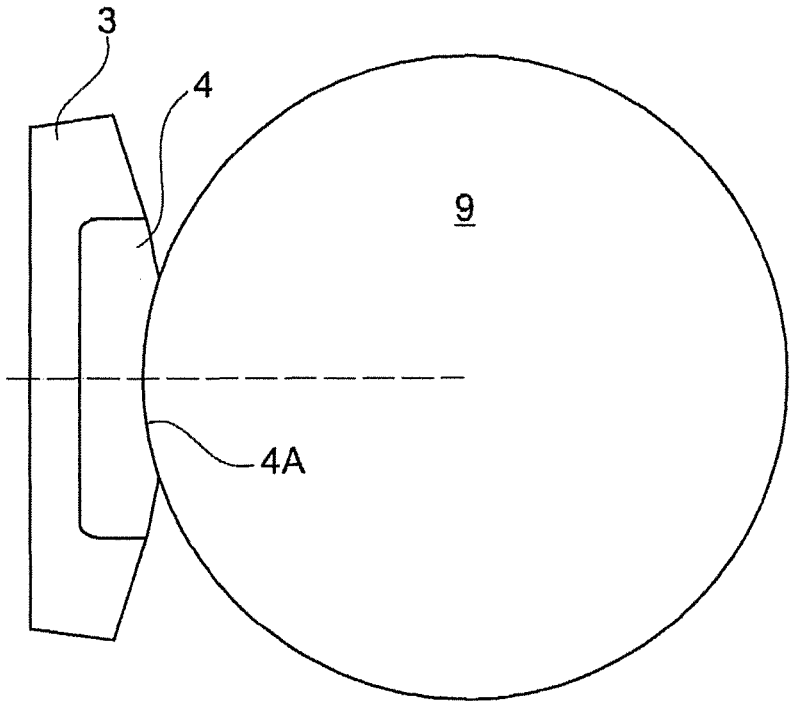
FIG. 3 shows a doctor blade chamber with a gasket where the gasket bears against the roller.

FIG. 3 shows a doctor blade chamber 3 in a typical operational position with a gasket 4 which bears against the roller 9 along the concave part 4A of the gasket 4.

Figure 4:
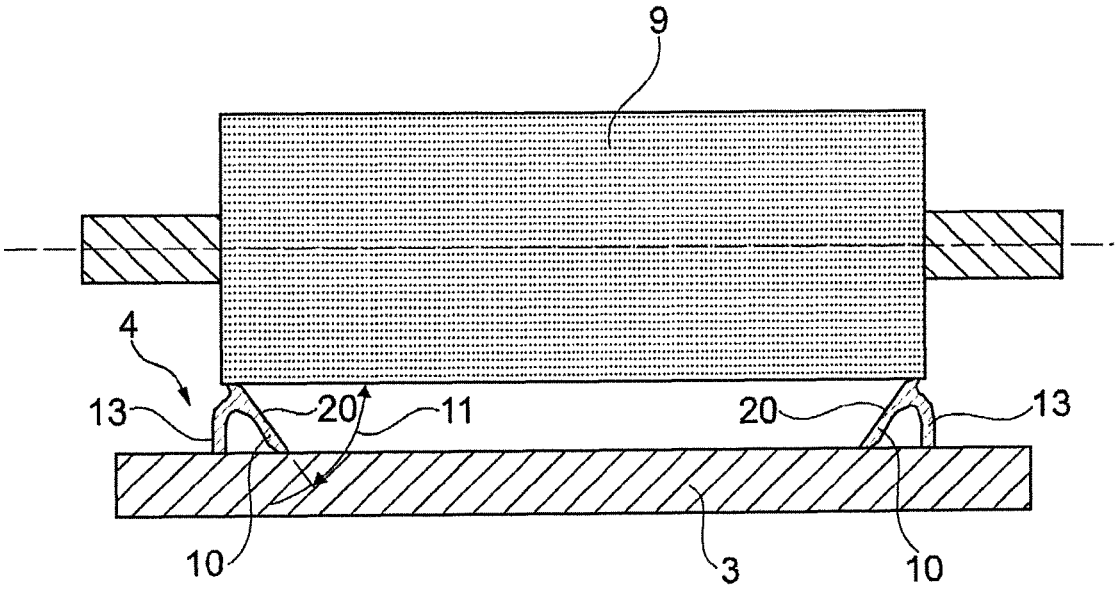
FIG. 4 shows a roller and a doctor blade chamber with two gaskets in cross-section.

FIG. 4 shows a roller 9 and a doctor blade chamber 3 with two gaskets 4 where the doctor blade chamber 3 and gaskets 4 are seen in cross-section. As it appears from this Figure, the gaskets 4 have a first leg 10 with an inclining surface 20, here shown with an angle 11 relative to the roller. The preferred size of the angle 11 is between 40° and 60°, but may well be greater as well as smaller.

Figure 5:
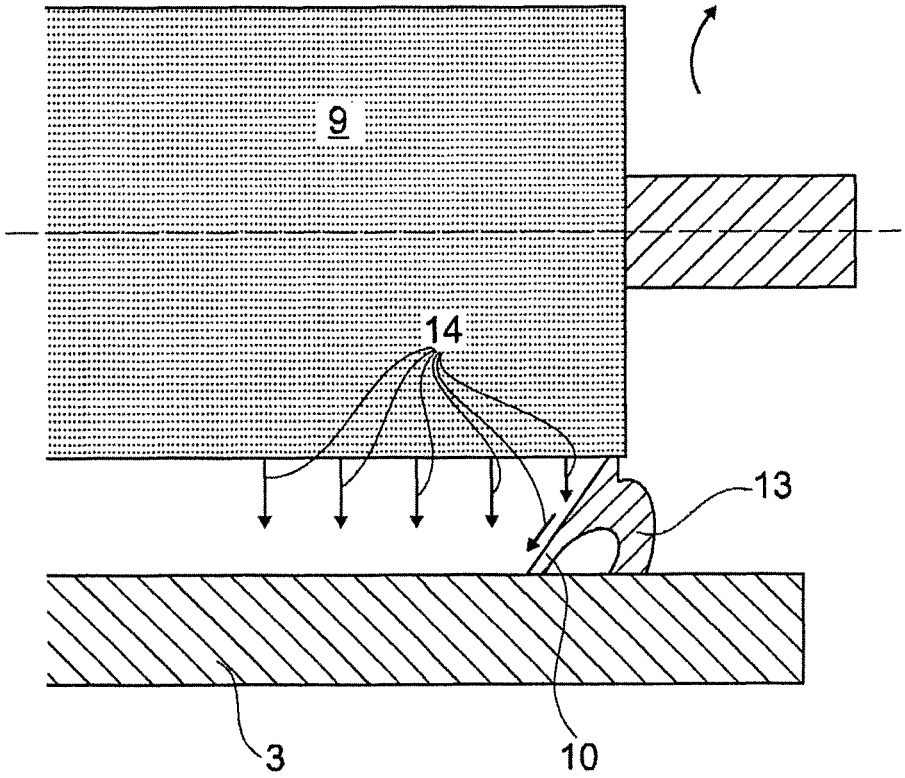
FIG. 5 shows a detail of a roller and a doctor blade chamber where the flow of the ink is shown illustrated by arrows.

FIG. 5 shows a detail of a roller 9 and a doctor blade chamber 3 where the flow of the ink is shown illustrated by arrows 14. The arrows 14 show how the ink is affected by the rotation of the roller so as to be flung away from the roller 9. At the point where the ink strikes the inclining face 20 on the gasket 4, the direction of the ink will be changed such that it flows along the inclining face 20 whereby an eddy or rotating flow along the surface 20 and away from the sealing area between gasket 4 and roller 9 will occur.

Figure 6:
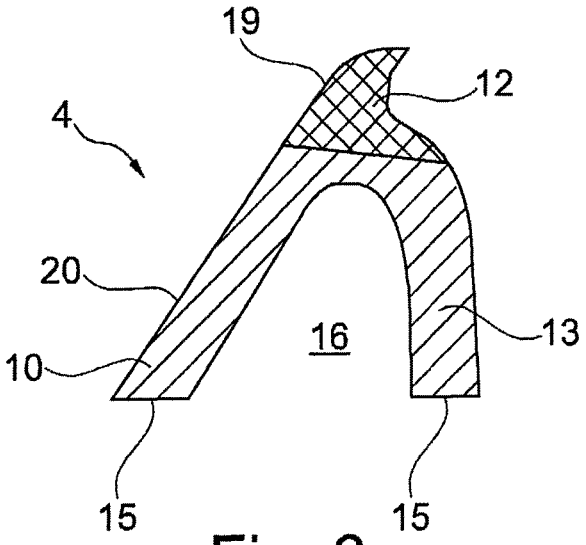
FIG. 6 shows the cross-section of a gasket with an inclining surface and with a rigid/supporting rail.

FIG. 6 shows the cross-section of a gasket 4 with an inclining surface 20 and with a rigid/supporting rail 12. In principle, it is the same gasket 4 as shown in FIG. 5, but here with the elastomeric edge 19 or a part of the latter provided with other material properties than the remainder of the gasket 4. As mentioned, the gasket 4 has a rigid/supporting rail 12 which at the inclining surface 20 has an elastomeric edge 19, shown here as the rail 12. The sealing surface 15 of the gasket towards the doctor blade chamber 3 is here constituted by the underside of the first leg 10 and the second leg 13 which due to the cutout 16 in the sealing face 15 of the gasket acts flexibly as well as a kind of double sealing due to the two legs 10, 13.

Figure 7:
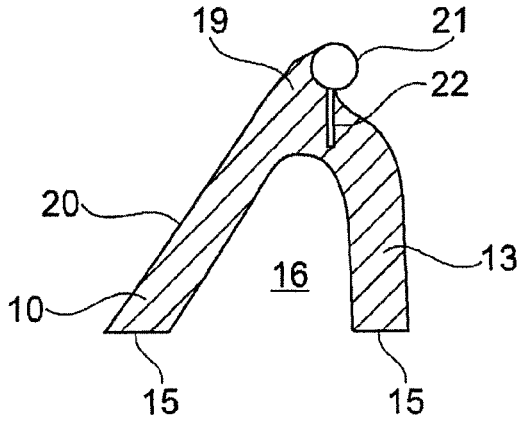
FIG. 7 shows the cross-section of a gasket with a convex surface and with a rigid/supporting rail in the form of a thread with anchor parts.

FIG. 7 shows the cross-section of a gasket 4 with a convex surface 20 and with a rigid/supporting rail 12 in the form of an embedded thread 21 with projecting anchor parts 22. The thread 21 and the mentioned anchor parts 22 are moulded into the elastomer that constitutes the body itself of the gasket 4.

Figure 8:
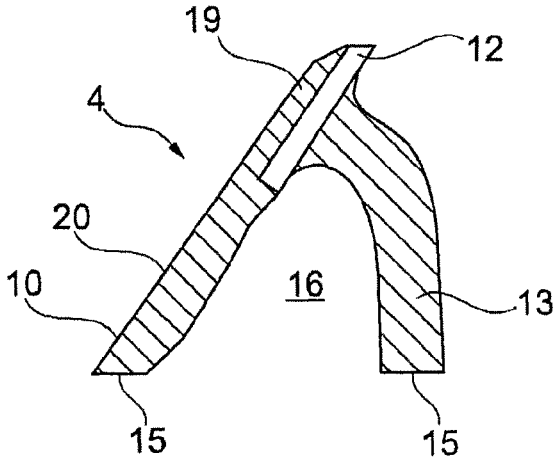
FIG. 8 shows the cross-section of a gasket with an inclining surface and with an angled rigid/supporting rail.

FIG. 8 shows the cross-section of a gasket 4 with an inclining surface 20 and with an angled rigid/supporting rail 12.

Figure 9:
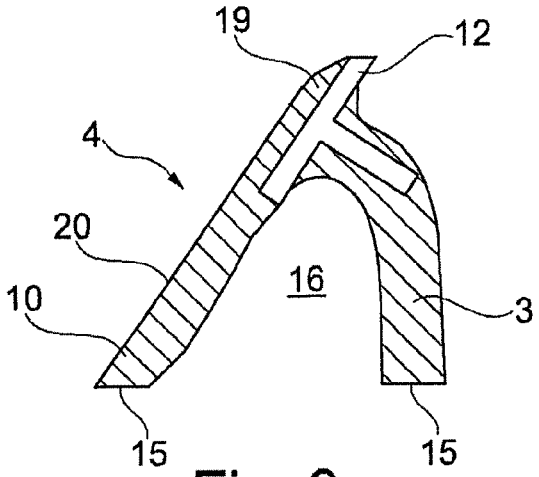
FIG. 9 shows the cross-section of a gasket with an inclining surface and with an angled and T-shaped rigid/supporting rail.

FIG. 9 shows the cross-section of a gasket 4 with an inclining surface 20 and with an angled and T-shaped rigid/supporting rail 12.

Figure 10:
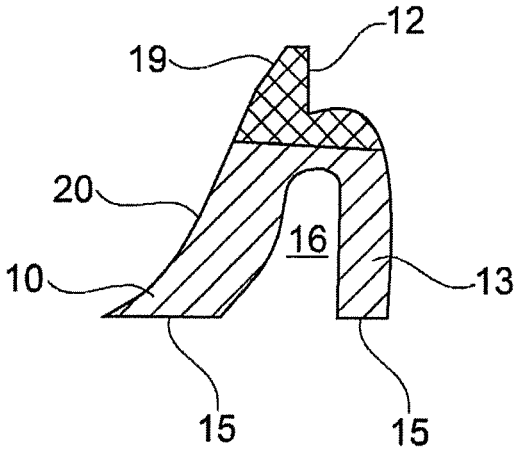
FIG. 10 shows the cross-section of a gasket with a concave surface and with a rigid/supporting rail produced by multi-component moulding.

FIG. 10 shows the cross-section of a gasket 4 with a concave surface 20 and with a rigid/supporting rail 12 produced by multi-component moulding. Thus there is an elastomeric part 19 which more or less is constituted by the rigid/supporting rail 12 itself.

Figure 11:
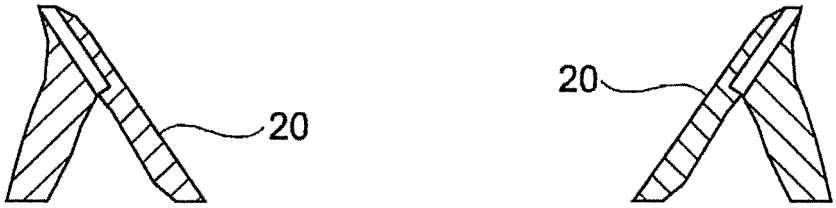
FIG. 11 shows two gaskets in which the inclining surfaces face against each other.

In FIG. 11 appears two gaskets 4 by which the inclining surfaces 20 face each other. This way of disposing the gaskets 4 are, as mentioned in the description of the invention above, particularly suited for so-called pressure-less systems wherein the pressure is the same in the doctor blade chamber 3 as outside thereof. The rigid/supporting rail 2, which is angled here, can then act resiliently in the gasket 4 and in that way be accurately adapted to the diameter of the roller.

Figure 12:
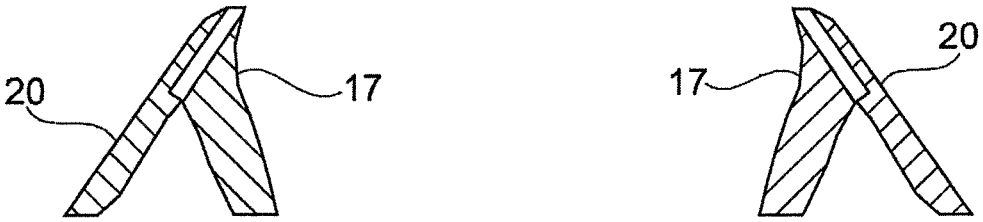
FIG. 12 shows two gaskets in which the inclining surfaces face away from each other.

FIG. 12 shows the same two gaskets 4 where the inclining surfaces 20 face away from each other, which as mentioned above is particularly suited when there is overpressure on the ink in the doctor blade chamber 3. The gaskets 4 will thus be affected by the overpressure of the ink on the back side 17 at the second leg 13 in direction against the not shown roller 9. The pressure thus presses the rigid/supporting rail 12 into bearing against the periphery of the roller. The higher the pressure, the more the rail 12 is pressed against the not shown roller 9.

Figure 13:
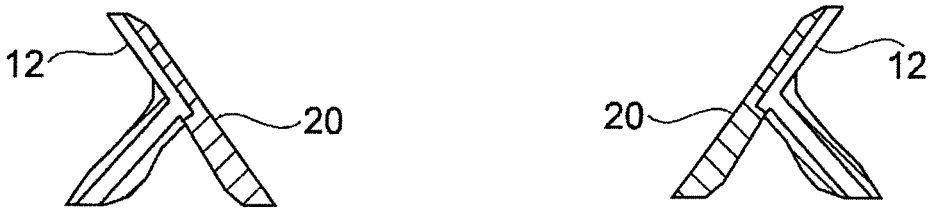
FIG. 13 shows two gaskets with a V-shaped rigid/supporting rail wherein the inclining surfaces face against each other.
Figure 14:
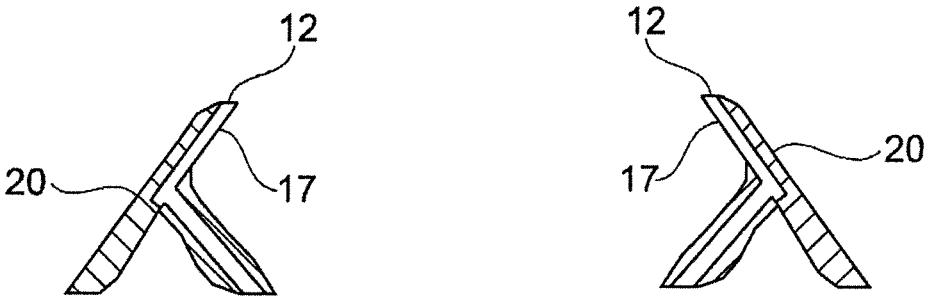
FIG. 14 shows two gaskets with a V-shaped rigid/supporting rail wherein the inclining surfaces face away from each other.

FIG. 13 shows two gaskets 4 with a V-shaped rigid/supporting rail 12 where the inclining surfaces 20 face each other in the same way as shown in FIG. 11, and FIG. 14 shows the same two gaskets 4 with V-shaped rigid/supporting rail 12 where the inclining surfaces face away from each other, corresponding to the view in FIG. 12.

Figure 15:
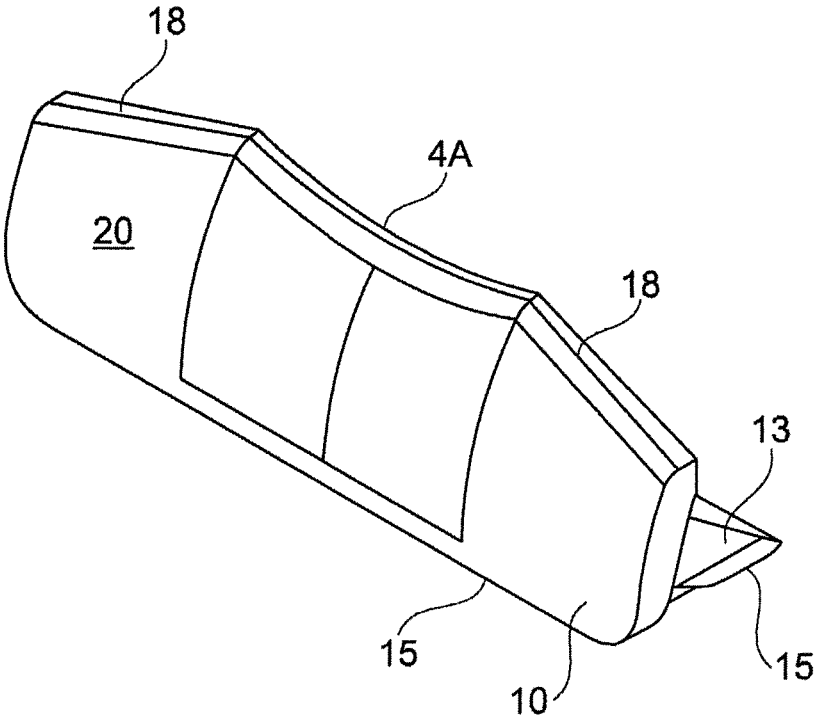
FIG. 15 shows a gasket in perspective view from above and from the side.

Finally, in FIG. 15 is shown a gasket 4 in perspective view from above and from the side. This gasket has a convex surface 20 on the first leg 10, and the second leg 13 is supported against the first leg 10 whereby the back side 17 on the surface 20, as shown in FIG. 14, appears concave. As it appears the gasket 4 has a central concave design 4A for bearing against a not shown roller 9 and two more rectilinear contact faces 18 for bearing against doctor blades 1, 2 as shown in FIG. 1.

Figure 16:
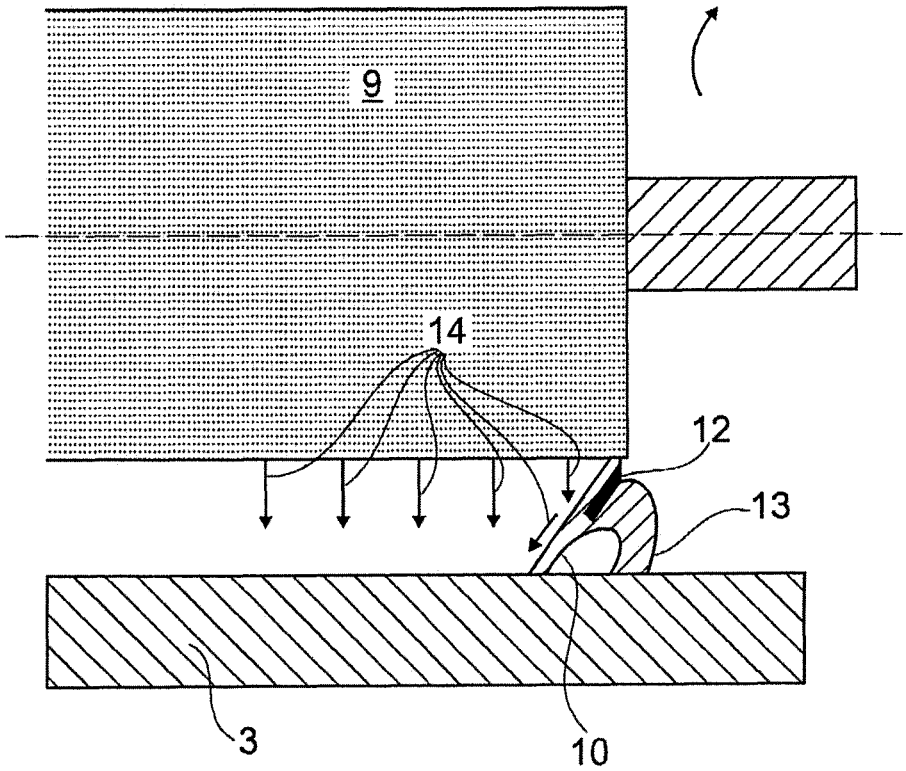
FIG. 16 is a view corresponding to that of FIG. 5, but of an alternative embodiment of the gasket.

As can be seen from the above described figures, the gasket 4 has an asymmetric shape in which the legs 10, 13, together with the elastomeric edge 19 combine to give the gasket 4 substantially a λ-shape or mirror-imaged λ-shape FIG. 16 shows a detail of a roller 9 and a doctor blade chamber 3 where the flow of the ink is shown illustrated by arrows 14. The arrows 14 show how the ink is affected by the rotation of the roller so as to be flung away from the roller 9. At the point where the ink strikes the inclining face 20 on the gasket 4, the direction of the ink will be changed such that it flows along the inclining face 20 whereby an eddy or rotating flow along the surface 20 and away from the sealing area between gasket 4 and roller 9 will occur. The gasket includes a rigid/supporting rail 12 which during operational conditions of the printing unit is spaced apart from the roller.

Figure 17:
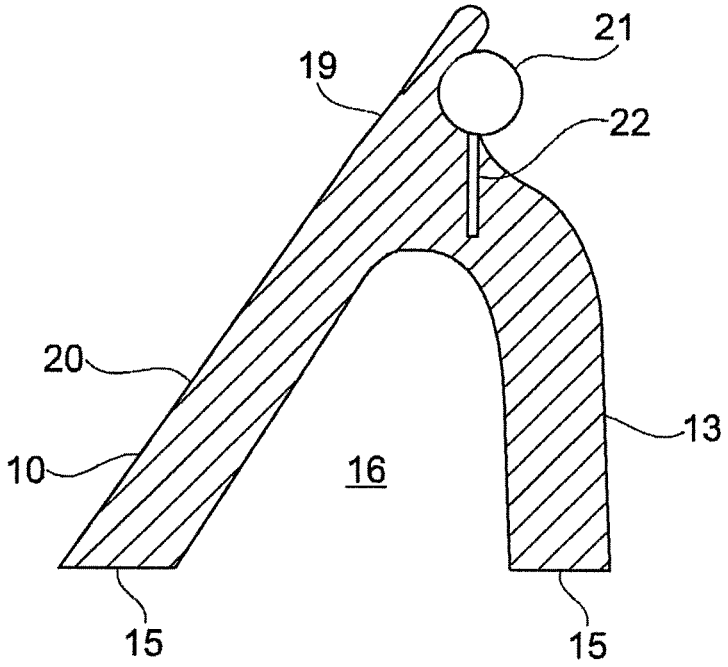
FIG. 17 is a view corresponding to that of FIG. 7, but of an alternative embodiment of the gasket.

FIG. 17 shows the cross-section of a gasket 4 with a convex surface 20 and with a rigid/supporting rail 12 in the form of an embedded thread 21 with projecting anchor parts 22. The thread 21 and the mentioned anchor parts 22 are moulded into the elastomer that constitutes the body itself of the gasket 4. The gasket includes a rigid/supporting rail for supporting the elastomeric edge, wherein the rigid/supporting rail has a distance from the elastomeric edge such that the elastomeric edge projects farther out from the body than the rail.

Figure 18:
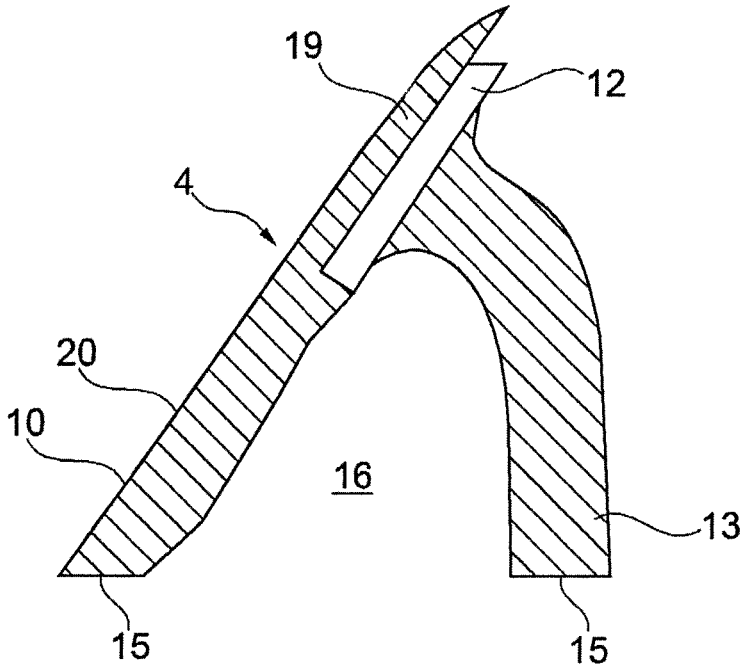
FIG. 18 a view corresponding to that of FIG. 8, but of an alternative embodiment of the gasket.

FIG. 18 shows the cross-section of a gasket 4 with an inclining surface 20 and with an angled rigid/supporting rail 12. The gasket includes a rigid/supporting rail for supporting the elastomeric edge, wherein the rigid/supporting rail has a distance from the elastomeric edge such that the elastomeric edge projects farther out from the body than the rail.

What is claimed is:

1. A printing unit with a doctor blade chamber and a rotatable roller where the roller extends partially into the doctor blade chamber for receiving ink from the doctor blade chamber during operation, wherein a gasket is provided for sealing between the doctor blade chamber and the roller, where the gasket at one side includes at least one sealing surface, the sealing surface having a width substantially corresponding to the width of the doctor blade chamber and a thickness in longitudinal direction of the roller, the thickness delimited by a first edge and a second edge at the sealing surface, wherein the gasket at its opposing side includes an elastomeric edge for sealing abutment against the roller, wherein the elastomeric edge is offset in longitudinal direction of the roller/doctor blade chamber relative to at least one of the edges that delimit the thickness on the sealing surface, where a surface extends from at least one of the edges delimiting the thickness on the sealing surface and to an area at the elastomeric edge/roller, wherein the gasket has a non-symmetric cross-sectional shape, wherein the surface constitutes a first leg comprising a backside, wherein said backside is supported by a second leg and where the gasket comprises one of: an inclining surface, corresponding to being angled less than 90° in relation to one of the sealing surface and the longitudinal direction of the roller/doctor blade chamber, a concave surface, a convex surface, and a concave and convex surface.

2. A printing unit with a doctor blade chamber and a rotatable roller according to claim 1, wherein the gasket includes a rigid/supporting rail which during operational conditions of the printing unit bears against the roller together with the elastomeric edge.

3. A printing unit with a doctor blade chamber and a rotatable roller according to claim 1, wherein the gasket includes a rigid/supporting rail which during operational conditions of the printing unit is spaced apart from the roller.

4. A printing unit with a doctor blade chamber and a rotatable roller according to claim 1, wherein the doctor blade chamber includes two gaskets, where each of the two gaskets includes one of: an inclining surface, a concave surface, a convex surface, and a concave and convex surface, where the surfaces of the gaskets face each other such that the distance between the two elastomeric edges is greater than the distance between the mutually facing edges at the sealing surface of the gasket.

5. A printing unit with a doctor blade chamber and a rotatable roller according to claim 1, wherein the doctor blade chamber includes two gaskets, where each of the two gaskets includes one of: an inclining surface, a concave surface, a convex surface, and a concave and convex surface, where the surfaces of the gaskets face away from each other such that the distance between the two elastomeric edges is less than the distance between the mutually facing edges at the sealing surface of the gasket.

6. A printing unit with a doctor blade chamber and a rotatable roller according to claim 1, wherein said legs together with the elastomeric edge combine to give the gasket substantially a λ-shape or mirror-imaged λ-shape.

7. A gasket for sealing between a doctor blade chamber and a rotatable roller in a printing unit, comprising:

a sealing surface at one side having a width substantially corresponding to the width of the doctor blade chamber and a thickness in longitudinal direction of the roller with which the gasket is to be used, the thickness being delimited by a first edge and a second edge at the sealing surface, wherein the gasket at an opposing side includes an elastomeric edge for sealing abutment against the roller, wherein the elastomeric edge is offset in longitudinal direction of the roller/doctor blade chamber relative to at least one of the edges that delimit the thickness on the sealing surface, where a surface extends from at least one of the edges delimiting the thickness on the sealing surface and to an area at the elastomeric edge/roller, wherein the gasket has a non-symmetric cross-sectional shape, where the surface constitutes a first leg comprising a backside, where said backside is supported by a second leg and where the gasket comprises one of: an inclining surface, corresponding to being angled less than 90° in relation to one of the sealing surface and the longitudinal direction of the roller/doctor blade chamber, a concave surface, a convex surface, and a concave and convex surface, and wherein the gasket further comprises a body.

8. A gasket for sealing between a doctor blade chamber and a rotatable roller in a printing unit according to claim 7, wherein the gasket includes a rigid/supporting rail for supporting the elastomeric edge, wherein the rigid/supporting rail extends from the body and to the elastomeric edge.

9. A gasket for sealing between a doctor blade chamber and a rotatable roller in a printing unit according to claim 8, wherein the rigid/supporting rail is arranged in the body of the gasket in a direction that substantially coincides with the inclined direction of the surface.

10. A gasket for sealing between a doctor blade chamber and a rotatable roller in a printing unit according to claim 7, wherein the gasket includes a rigid/supporting rail for supporting the elastomeric edge, wherein the rigid/supporting rail has a distance from the elastomeric edge such that the elastomeric edge projects farther out from the body than the rail.

11. A gasket for sealing between a doctor blade chamber and a rotatable roller in a printing unit according to claim 10, wherein the rigid/supporting rail is arranged in the body of the gasket in a direction that substantially coincides with the inclined direction of the surface.

12. A gasket for sealing between a doctor blade chamber and a rotatable roller in a printing unit according to claim 7, wherein the gasket includes a rigid/supporting rail for supporting the elastomeric edge, where the rigid/supporting rail includes a thread, where the thread is arranged in the body of the gasket in a direction that substantially coincides with the width direction of the gasket.

13. A gasket for sealing between a doctor blade chamber and a rotatable roller in a printing unit according to claim 12, wherein said thread comprises projecting anchor parts.

14. A gasket for sealing between a doctor blade chamber and a rotatable roller in a printing unit according to claim 7, wherein the gasket includes a rigid/supporting rail for supporting the elastomeric edge, where the rigid/supporting rail has a varied cross-section at least in the width direction of the gasket.

15. A gasket for sealing between a doctor blade chamber and a rotatable roller in a printing unit according to claim 7, wherein the gasket includes a rigid/supporting rail for supporting the elastomeric edge, and where the body of the gasket is made of rubber with a first rigidity/hardness, and that the rigid/supporting rail is made of a thermoplastic, and with a second rigidity/hardness, wherein the second rigidity/hardness is greater than the first rigidity/hardness.

16. A gasket for sealing between a doctor blade chamber and a rotatable roller in a printing unit according to claim 7, wherein the gasket includes a rigid/supporting rail for supporting the elastomeric edge, and where the body of the gasket is made of an elastomer with a first rigidity/hardness, and that the rigid/supporting rail is made of an elastomer with a second rigidity/hardness, wherein the second rigidity/hardness is greater than the first rigidity/hardness, and wherein the gasket constitutes a unit produced by multi-component moulding in one single operation.

17. A gasket for sealing between a doctor blade chamber and a rotatable roller in a printing unit according to claim 7, wherein said legs together with the elastomeric edge combine to give the gasket substantially a λ-shape or mirror-imaged λ-shape.

* * * * *